United States Patent [19]

Lew et al.

[11] Patent Number: 4,600,974

[45] Date of Patent: Jul. 15, 1986

[54] OPTICALLY DECORATED BATON

[76] Inventors: Hyok S. Lew, 7890 Oak St., Arvada, Colo. 80005; John W. Elias, 3018 4th St., Boulder, Colo. 80302

[21] Appl. No.: 702,688

[22] Filed: Feb. 19, 1985

[51] Int. Cl.[4] ..... A45B 3/02

[52] U.S. Cl. ..... 362/102; 362/84; 362/223; 362/171

[58] Field of Search ..... 362/102, 202, 34, 84, 362/109, 223, 114, 171; 84/477 B; D21/100

[56] References Cited

U.S. PATENT DOCUMENTS

| | | | |
|---|---|---|---|
| 2,225,151 | 12/1940 | Borba | 84/477 B |
| 2,242,981 | 5/1941 | Pedersen | 84/477 B |
| 2,361,841 | 10/1944 | Healy | 84/477 B |
| 2,363,131 | 11/1944 | Haggart, Jr. | 84/477 B |
| 2,616,202 | 11/1952 | Romberger | 362/109 |
| 2,681,979 | 6/1954 | Manoloff | D21/100 |
| 3,918,708 | 11/1975 | Augusta | 84/477 B |
| 4,013,881 | 3/1977 | Sargent | 362/102 |
| 4,106,079 | 8/1978 | Drury | 362/102 |
| 4,208,701 | 6/1980 | Schock | 362/102 |
| 4,285,032 | 8/1981 | Honda et al. | 362/223 |
| 4,345,305 | 8/1982 | Kolm et al. | 362/223 |

*Primary Examiner*—E. Rollins Cross

[57] ABSTRACT

This invention relates to a baton comprising a transparent tube and an active or passive light-emitting tube of a smaller diameter disposed substantially coaxially within the transparent tube, which combination is sealed at two extremities thereof. The annular cylindrical space between the transparent tube and the light-emitting tube is filled with a liquid including numerous suspended particles with light-reflecting surfaces. The optically decorated baton may be used as a toy, twirling baton, night time safety light for joggers and bicycle riders, guide marker for traffic cops directing traffic, for ground crews guiding taxiing airplanes, and as highway emergency markers.

19 Claims, 8 Drawing Figures

OPTICALLY DECORATED BATON

BACKGROUND OF THE INVENTION

Numerous platelets with light-reflecting colored surfaces suspended in a liquid medium display a spectacular phenomena when the liquid medium is agitated under an appropriate illumination. When the combination of the liquid medium including numerous platelets with light-reflecing colored surfaces and a passive or active light source illuminating the movements of those particles is packaged in the form of portable object such as a baton, it provides many useful applications as a toy, recreational apparatus, a marker for night time use, warning marker, etc.

The primary object of the present invention is to provide an optically decorated baton comprising of a sealed transparent tube including a light-emitting cylinder coaxially disposed therein and a fluid medium including numerous suspended colored reflective platelets confined in an annular cylindrical space intermediate the transparent tube and the light-emitting cylinder.

Another object is to provide an optically decorated baton wherein the light-emitting cylinder comprises a transparent tube with an inner surface coated with phosphorescent material.

A further object is to provide an optically decorated baton wherein the light-emitting cylinder comprises a transparent tube with an inner surface coated with fluorescent material.

Yet another object is to provide an optically decorated baton wherein the light-emitting cylinder comprises a transparent tube illuminated by the light emitting from a light bulb powered by the electric battery, which light bulb is disposed at one extremity of the light emitting tube.

These and other objects of the present invention will become clear as the description thereof proceeds.

BRIEF DESCRIPTION OF FIGURES

The present invention may be described with a greater clarity and specificity by referring to the following figures.

DESCRIPTION OF THE ILLUSTRATED EMBODIMENTS

Figure 1:
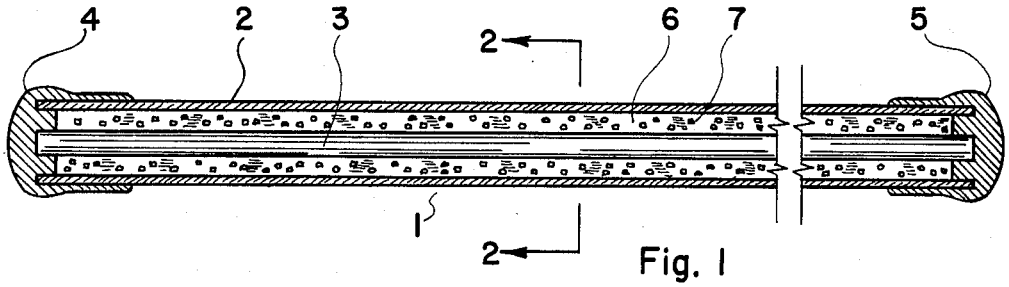
FIG. 1 illustrates a cross section of an optically decorated baton taken along a plane including the central axis thereof.

In FIG. 1 there is illustrated a cross section of an optically decorated baton 1 taken along a plane including the central axis thereof. The optically decorated baton 1 comprises a transparent tube 2 and a light-emitting cylinder 3 coaxially disposed within the transparent tube 2. Both ends of the coaxial combination of the transparent tube 2 and the light-emitting tube 3 are sealed by a pair of caps 4 and 5 in a leak-proof manner. The sealed off annular cylindrical space intermediate the transparent tube 2 and the light-emitting cylinder 3 is filled of a liquid 6 including numerous suspended platelets 7 having colored light-reflecting surfaces. The suspended platelets 7 may have one type of color or they may be a collection of platelets of two or more different colors. The light radiating from the light-emitting cylinder 3 becomes reflected by the suspended platelets 7 and, consequently, the tumbling and wandering movements of the platelets 7 created by the agitated fluid medium 6 are depicted and revealed optically that pleases the observer's eyes. As the light radiating from the assembly of the optically decorated baton 1 flickers and fluctuates dynamically, it is easier to notice the optically decorated baton 1 from a distance at night time.

Figure 2:
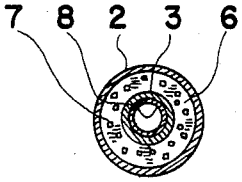
FIG. 2 illustrates another cross section of the optically decorated baton shown in FIG. 1.

In FIG. 2 there is shown another cross section of the optically decorated baton 1 shown in FIG. 1, which cross section is taken along a plane 2—2 as shown in FIG. 1. In this particular embodiment, the light-emitting cylinder 3 is made of a transparent tube of a smaller diameter with its inner cylindrical surface 8 coated with phosphorescent material or fluoroscent material. This type of light-emitting cylinder is designated as the "passive light-emitting cylinder" and distinguished from the "active light-emitting cylinder" to be discussed in conjunction with FIGS. 7 and 8.

Figure 3:
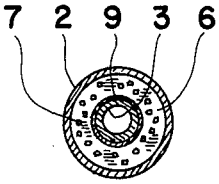
FIG. 3 illustrates a cross section equivalent to that shown in FIG. 2 of another embodiment of the optically decorated baton.

In FIG. 3 there is illustrated a cross section equivalent to that shown in FIG. 2 of another embodiment of the optically decorated baton constructed as shown in FIG. 1. In this embodiment, the outer cylindrical surface 9 of the tube constituting the light-emitting cylinder 3 is coated with phosphorescent or fluorescent material and water-proofed thereon.

Figure 4:
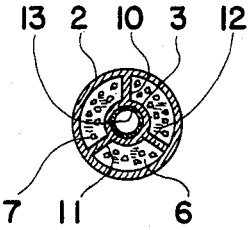
FIG. 4 illustrates a cross section equivalent to that shown in FIG. 2 of a further embodiment of the optically decorated baton.

In FIG. 4 there is illustrated a cross section equivalent to that shown in FIG. 2 of a further embodiment of the optically decorated baton constructed as shown in FIG. 1. In this particular embodiment, the transparent tube of a smaller diameter constituting the light-emitting cylinder 3 is connected to the transparent tube 2 by a plurality of webs 10, 11, 12, etc. extending radially therefrom. The inner cylindrical surface 13 of the transparent tube 3 is coated with phosphorescent or fluorescent material.

Figure 5:
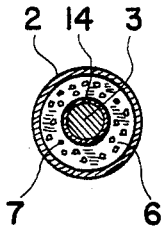
FIG. 5 illustrates a cross section equivalent to that shown in FIG. 2 of yet another embodiment of the optically decorated baton.

In FIG. 5 there is illustrated a cross section equivalent to that shown in FIG. 2 of yet another embodiment of the optically decorated baton constructed as shown in FIG. 1. In this embodiment, the light-emitting cylinder 3 comprises a solid cylinder with its cylindrical surface 14 coated with phosphorescent or fluorescent material and water-proofed thereon.

Figure 6:
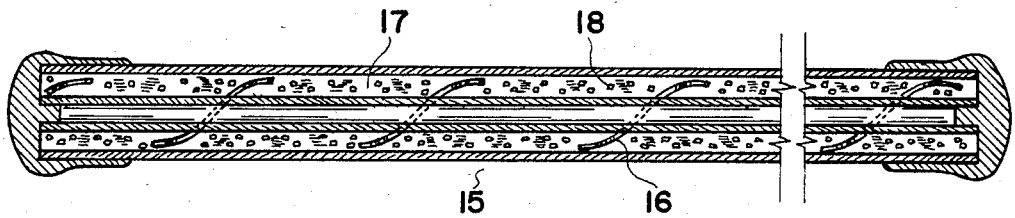
FIG. 6 illustrates a cross section of yet a further embodiment of the optically decorated baton.

In FIG. 6 there is illustrated another optically decorated baton 15 that is constructed essentially in the same manner as the optically decorated baton 1 shown in FIG. 1 with one exception being that one or more helical ribbons or bands 16 is added for additional decorative effect. The helical ribbons or bands 16, that is immersed in the fluid medium 17 including numerous light-reflecting colored platelets 18 and coiled around the light-emitting cylinder, has light-reflecting surfaces and is colored with one or more different colors.

Figure 7:
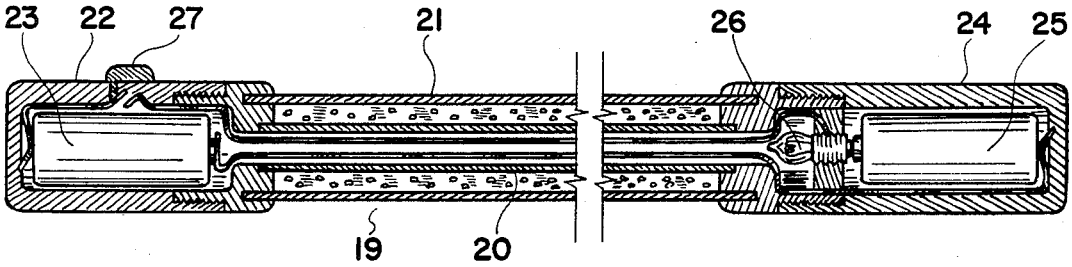
FIG. 7 illustrates a cross section of an optically decorated baton including a light-emitting tube illuminated by a light bulb.

In FIG. 7 there is illustrated a cross section of an optically decorated baton 19 including an active light-emitting tube 20 coaxially disposed within the transparent tube 21. One end of the combination of the outer transparent tube 21 and the inner transparent tube 20 is sealed with a first end cap 22 housing a dry cell battery 23, while the other end thereof is sealed with a second end cap 24 housing a dry cell battery 25 and a light bulb 26. The wiring connecting the batteries 23 and 25, and the light bulb 26 to each other are routed through the inner transparent tube 20. The end cap 22 includes a switch 27 that turns on and off the light bulb 26. The sealed annular cylindrical space intermediate the outer transparent tube 21 and the inner transparent tube 20 is filled with a fluid including numerous suspended light-reflecting particles as described in conjunction with FIG. 1. It is desirable to leave a small air space in filling the annular cylindrical space intermediate the inner and outer transparent tubes with a fluid medium including numerous light-reflecting particles in order to provide a violent agitation of those suspended particles by tilting the baton back and forth. Of course, it is a matter of design to employ only a single battery in powering the light bulb, which are included in one end cap, e.g., the second end cap 24, while the first end cap 22 is made to counter-balance the weight of the second end cap 24 without housing any battery.

Figure 8:
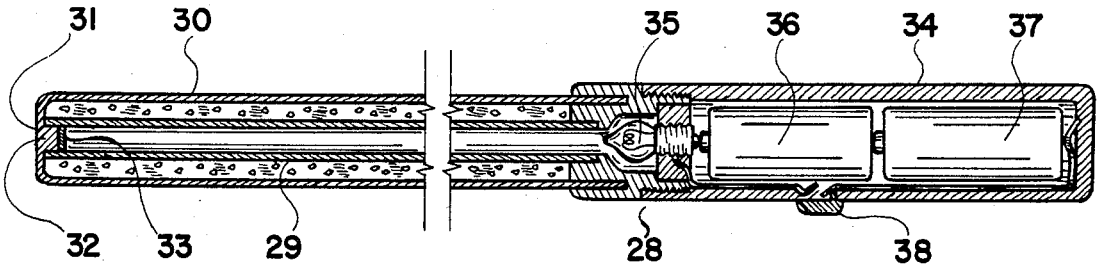
FIG. 8 illustrates a cross section of another optically decorated baton including a light-emitting tube illuminated by a light bulb.

In FIG. 8, there is illustrated a cross section of another optically decorated baton 28 employing an active light-emitting cylinder 29 coaxially disposed within the outer transparent cylinder 30 with one sealed extremity 31 that includes a plug 32 plugging one end of the inner transparent tube 29 constituting the light-emitting cylinder. The tip of the plug 32 may include a light-reflecting plate 33 for boosting the illumination. The other end of the combination of the outer and inner transparent tubes are sealed by an end cap 34 that includes a light bulb 35 and one or more dry cell batteries 36, 37, etc. The end cap 34 also includes a switch 38 for turning on and off the light bulb 35. The light emitting from the light bulb 35 travels following the inner transparent tube and radiates therefrom in the radial directions illuminating the light reflecting particles suspended in the fluid medium nearly but not completely filling the annular cylindrical space intermediate the outer and inner transparent tubes 29 and 30. It is matter of design to incorporate a dummy cap that is disposed at the closed end of the outer transparent tube 30 in order to provide a symmetric appearance of the optically decorated baton 28. It should be understood that the light-reflecting colored helical ribbons or bands which was described in conjunction with FIG. 6, may be incorporated into those optically decorated batons shown in FIGS. 7 and 8.

While the principles of the present invention have now been made clear by the illustrative ebodiments, it will be immediately obvious to those skilled in the art many modification of structures, arrangements, proportion, elements and materials which are particularly adapted to the specific working environments and operating conditions in the practice of the invention without departing from those principles.

We claim:

1. An optically decorated baton comprising in combination: An outer transparent tube and a light-emitting cylinder disposed substantially coaxially within said outer transparent tube wherein said light-emitting cylinder is illuminated by at least one light bulb disposed at one extremity of said light-emitting cylinder and lighted by at least one electric battery, said combination of said outer transparent tube and said light-emitting cylinder sealed by a first closure means at one extremity and by a second closure means at the other extremity providing a sealed annular cylindrical space intermediate said outer transparent tube and said light-emitting cylinder wherein said annular cylindrical space includes a fluid medium including numerous light-reflecting particles of one or more colors.

2. The combination as set forth in claim 1 wherein said light-emitting cylinder comprises an inner transparent tube with inner cylindrical surface coated with phosphorescent material.

3. The combination as set forth in claim 2 wherein said outer and inner transparent tubes are connected to one another by one or more webs respectively disposed in substantially radial directions.

4. The combination as set forth in claim 1 wherein said light-emitting cylinder comprises an inner tube with outer cylindrical surface coated with phosphorescent material.

5. The combination as set forth in claim 1 wherein said light-emitting cylinder comprises a solid cylinder with cylindrical surface coated with phosphorescent material.

6. The combination as set forth in claim 1 wherein said light-emitting cylinder comprises an inner transparent tube with inner cylindrical surface coated with fluorescent material.

7. The combination as set forth in claim 6 wherein said outer and inner transparent tubes are conencted to one another by one or more webs respectively disposed in substantially radial directions.

8. The combination as set forth in claim 1 wherein said light-emitting cylinder comprises an inner tube with outer cylindrical surface coated with fluorescent material.

9. The combination as set forth in claim 1 wherein said light-emitting cylinder comprises a solid cylinder with cylindrical surface coated with fluorescent material.

10. The combination as set forth in claim 1 wherein one or more light-reflecting colored helical ribbon coiling around said light-emitting cylinder is disposed in said sealed annular cylindrical space intermediate said outer transparent tube and said light-emitting cylinder.

11. The combination as set forth in claim 1 wherein said light-emitting cylinder comprises an inner transparent tube illuminated by at least one light bulb disposed at one extremity of said inner transparent tube, said light bulb powered by at least one battery housed in a housing connected to said first closure mean.

12. The combination as set forth in claim 11 wherein said combination includes a switch means for switching on and off said light bulb.

13. The combination as set foth in claim 12 wherein one or more light-reflecting colored helical ribbon coiling around said light-emitting cylinder is disposed in said sealed annular cylindrical space intermediate said outer transparent tube and said light-emitting cylinder.

14. An optically decorated baton comprising in combination: an outer transparent tube with one closed end and an inner transparent tube with one closed end disposed substantially coaxially within said outer transparent tube, said combination of said outer and inner transparent tubes sealed by a closure means at the other extremity opposite to said one closed ends of said outer and inner transparent tubes providing a sealed annular cylindrical space intermediate said outer and inner transparent tubes wherein said sealed annular cylindrical space includes a fluid medium including numerous light-reflecting particles of one or more colors, said inner transparent tube including at least one light bulb disposed at the other extremity of said inner transparent tube opposite to said one closed end wherein said light bulb is powered by at least one battery housed in a housing connected to said closure means.

15. The combination as set forth in claim 14 wherein said combination includes a switch means for switching on and off said light bulb.

16. The combination as set forth in claim 15 wherein one or more light-reflecting colored helical ribbon coiling around said light-emitting cylinder is disposed in said sealed annular cylindrical space intermediate said outer transparent tube and said light-emitting cylinder.

17. An optically decorated baton comprising in combination: an outer transparent tube and an inner transparent tube disposed substantially coaxially within said outer transparent tube, said combination of said outer transparent tube and said inner transparent tube including a first closure means included at one extremity thereof and a second closure means included at the other extremity opposite to said one extremity providing a sealed annular cylindrical space intermediate said outer transparent tube and said inner transparent tube; a fluid medium including a plurality of light reflecting particles of one or more colors; an electric light bulb disposed at one extremity of said inner transparent tube for emitting light traveling through said inner transparent tube; at least one dry cell included in a housing extending substantially in a coaxial relationship from said one extremity of said combination of said outer and inner transparent tubes providing energy to said light bulb; and at least one dry cell included in another housing extending substantially in a coaxial relationship from said the other extremity of said combination of said outer and inner transparent tubes providing energy to said light bulb.

18. The combination as set forth in claim 17 wherein said combination includes a switch means for switching on and off said light bulb.

19. The combination as set forth in claim 18 wherein at least one colored helical ribbon coiled around said inner transparent tube is included in said annular cylindrical space intermediate said outer transparent tube and said inner transparent tube.

* * * * *